United States Patent [19]

Willis

[11] 4,268,322

[45] May 19, 1981

[54] STRESS RELIEF OF ALUMINIUM RINGS

[75] Inventor: Alan W. Willis, Hagley, England

[73] Assignee: Daniel Doncaster & Sons Limited, Wadsley Bridge, England

[21] Appl. No.: 58,033

[22] Filed: Jul. 16, 1979

[30] Foreign Application Priority Data

Jul. 19, 1978 [GB] United Kingdom ..... 30276/78

[51] Int. Cl.[3] ..... C22F 1/04

[52] U.S. Cl. ..... 148/12.7 A

[58] Field of Search ..... 148/11.5 A, 12.7 A

[56] References Cited

FOREIGN PATENT DOCUMENTS 924443 4/1963 United Kingdom .

1544937 4/1979 United Kingdom .

OTHER PUBLICATIONS

Klient et al., Stress Relief in Aluminum Forgings, Light Metal Age, Feb. 1958, pp. 14–21.

*Primary Examiner*—R. Dean

*Attorney, Agent, or Firm*—R. J. Kenny; E. A. Steen

[57] ABSTRACT

A method for producing aluminum rings without developing undesirable residual stresses. A hot ring blank is ring rolled to a diametric size ranging approximately between 1% and 3% smaller than the desired dimensions of the finished ring. The ring is subsequently heated, quenched, subjected to cold ring working, and then aged prior to final machining.

11 Claims, No Drawings

STRESS RELIEF OF ALUMINIUM RINGS

The present invention relates to an improved method of producing rings from aluminium based alloys. In particular it relates to the production of rings from high and medium strength aluminium alloys in which a solution heat treatment and subsequent quenching operation cause the alloy to develop residual stresses which must be removed prior to final machining.

Seamless or flash welded rings of such aluminium based alloys are used in supportive roles in many applications such as aircraft engine-pods, gun mountings and in precision ball bearing assemblies. Such rings are typically produced by ring rolling, in either a horizontal or vertical ring rolling mill. In a horizontal ring rolling mill a hot ring blank is placed over an idler roll which has an outside diameter of less than the inside diameter of the blank. The idler roll is moved laterally towards a driven roll and applies pressure to the diameter of the blank. Rotation of the driven roll causes the blank and the idler (pressure) roll to rotate in the opposite direction and as the blank rotates between the rolls under squeezing pressure its cross section is decreased and circumference increased. The vertical ring rolling mill operates in the same manner but the blank rotates in the vertical plane instead of the horizontal plane. The blank is located on the driven roll and rotates in the same direction whilst the pressure roll rotates in the opposite direction. After ring rolling the ring is heat treated and quenched, this latter stage causing stress to develop.

Such stress causes subsequent warpage and must be relieved prior to final machining. In these high and medium strength aluminium alloys this is normally carried out by controlled mechanical deformation, by stretching or compressing the part sufficient to achieve a small but controlled amount of plastic deformation of the order of 1 to 3%. U.K. Pat. No. 924 443 discloses an expansion process for stress relieving in which the ring is clamped in a device in which it is expanded all round uniformly to above the stress value at which it undergoes a permanent increase in diameter in order to eliminate the residual internal stresses. An alternative compression process is described in the paper Stress Relief in Aluminium Forgings by Kleint & Janney, Light Metal Age-February 1958. Both processes cause the residual stress to be aligned in the direction of working and thus decrease stress differences in the thickness direction, and are commonly applied to rings and other forge or mill products. However for rings having large diameters, for example in excess of 1 meter, and/or of comparatively large section, these deformation processes require equipment of greater capacity than is normally found in most manufacturing plants. Typically presses of 12000 tons are required for compression and of more than 500 tons for stretching. Other major disadvantages of these processes are the need for special dies and jaws for equipment and the need for critical machining of the finished rings to recover roundness lost during the stress-relieving process.

U.K. Pat. No. 1 544 937 has recently been published disclosing a process for the production of contoured profile metal rings without machining. In this process a blank in the form of a ring is cold rolled to increase its diameter and alter its cross sectional countour, the cold rolling being carried out in successive stages using respective sets of dies each providing a variation in the diameter and/or contour of the ring. The process is particularly suitable for the production of rings from metal strip or bar, butt-welded to form a ring shape. The patent specification states that care must be taken to avoid setting up internal circumferential stresses in the ring, and discloses that the ring should be annealed each time that a 20% reduction in thickness is achieved during the plurality of cold rolling stages in order to limit such internal stresses.

The present invention is based on the surprising discovery that the residual stresses of a ring formed by a conventional ring rolling process may be relieved by a cold rolling process.

According to the present invention a process for the production of aluminium alloy rings comprises ring rolling a hot ring blank of the alloy to a diametric size between 1 and 3% smaller than the desired dimensions of the finished ring, heating the ring to above and solidus point of the alloy, and after quenching, cold ring-rolling the ring to the desired dimension whereby residual stresses in the alloy are relieved, and aging the ring prior to final machining. By cold ring rolling is meant ring rolling at a temperature below the precipitation temperature of the aluminium alloy, i.e. the temperature at which the alloy is precipitation aged. Preferably the cold ring rolling is carried out at room temperature. Cold ring rolling must be carried out as soon as possible after quenching, and normally within 24 hours because natural precipitation hardening commences immediately after the quench.

The alloy blank for use in processes of the present invention may be produced by punching a central hole in a slice of appropriate thickness cut from a solid cylindrical billet of the aluminium alloy. Alternatively the starting blank may be a flash-welded ring of aluminium-based alloy or may be a hollow cast blank. Dependent upon the nature of the alloy, the blank may need a specific forging operation prior to use in the process. The hot ring rolling is carried out at conventional forging temperatures. The ring so obtained is then subjected to a conventional solution treatment, and is quenched. After cold ring rolling the ring may be rough machined before or after applying the conventional precipitation aging treatment.

The process of the present invention may be applied to any aluminium alloys susceptible to residual stresses arising from heat treatment and quenching. It is particularly usefully applied to alloys such as those used in the aerospace industry for example alloy 2L 77 (BS1472-HF15) having the nominal specification (Al-4.4 Cu-0.5 Mg-0.7 Si-0.8 Mn) and DTD.731.B (BS1472-HF16) having the nominal specification (Al-2 Cu-15 Mg-1 Fe-1 Ni), and their equivalents. The U.S. equivalent designations of alloys 2L 77 and DTD.731.B are Aluminum Association alloy numbers 2014 and 2618 respectively. Temperatures for the heat treatments of such alloys are specified in the standards associated with them and these are used in the present process. As an example the solution treatment for 2L.77 consists of heating at 500°±5° C. and quenching in water at 40° to 70° C. Subsequent heating at 160° to 190° C. for the requisite period is used subsequently for precipitation aging of the alloy.

By use of the present invention aluminium alloy rings, even of large diameter and/or large cross section can be produced on a conventional ring rolling mill. The capacity of the rolling mill dictates the maximum thickness of the ring from which stress can be eliminated, because the forces applied by the rolling mill must cause plastic deformation of the ring in order for the stresses to redistribute. However an 8 ft (2.438 m) diameter ring can be produced on a Wagner mill of about 120 tonnes capacity from a forged preform of approximately 180 mm thickness, approximately 850 mm outer diameter and 500 mm inner diameter made of 2L 77 aluminium alloy. The stress relieving of the present invention is achieved with the input of comparatively low power because the load is applied over a small area at a time and therefore rings can be prepared at significantly lower cost, and yet with no loss of metallurgical properties. A further advantage of the present process is that during the cold ring-rolling stage, the ring is being subjected to a far more controlled deformation than is achieved from prior art processes. As a result of this control the ring is kept round and needs no critical machining to finish it.

Some examples will now be given.

EXAMPLE 1

A forged preform of 2L 77 aluminium alloy having the spot composition Cu 4.4, Mg 0.5, Si 0.7, Mn 0.8, Bal Al was produced by conventional methods having the dimensions 838.2 mm outside diameter, 508 mm inside diameter and 171.5 mm thickness. This preform was ring-rolled at conventional temperature on a Wagner ring-rolling mill using a load of 120 ton, to a size of 2.165 m outside diameter 2.026 m inside diameter and 120.65 mm thickness. The ring was solution treated by heating to 530° C. and quenching in water and was then rolled at room temperature on the same mill until its external diameter was 1.5% larger than its original starting size. The ring was then rough machined and precipitation hardened.

The ring was subjected to a number of tests as follows:

(1) Sections were taken in the longitudinal and transverse direction. When etched these revealed a fairly fine and uniform grain structure except near the ring surface where some folding had occurred during ring-rolling. These however could readily be removed by a slight increase in the amount of metal removed during the rough machining operation.

(2) In order to measure the amount of internal stress the amount which the ring tended to close up when sawn through was determined. The amount of movement was measured using scribed marks and found to be a closure of 88 mm. By calculation, the internal stress in the component was, therefore, about 40 MPa (about 2.5 tons/sq. in.).

(3) Tensile tests were taken in the axial, radial and circumferential directions at four positions separated by 90° around the ring. The results obtained are given in Table 1 below in which So is cross sectional area.

TABLE 1

| Test Direction | 0.1% Proof (Stress) MPa | 0.2% Proof (Stress) MPa | Max. Stress MPa | Elongation % 5.65/So |
|---|---|---|---|---|
| Radial | 382 | 396 | 458 | 7.5 |
| Circumferential | 437 | 448 | 492 | 8.9 |
| Axial | 406 | 420 | 462 | 6.25 |
| Radial | 384 | 400 | 456 | 7.5 |
| Circumferential | 434 | 445 | 489 | 8.9 |
| Axial | 404 | 418 | 468 | 7.5 |
| Radial | 390 | 404 | 462 | 7.5 |
| Circumferential | 436 | 447 | 495 | 9.8 |
| Axial | 416 | 428 | 464 | 7.5 |
| Radial | 386 | 398 | 456 | 10.0 |

TABLE 1-continued

| Test Direction | 0.1% Proof (Stress) MPa | 0.2% Proof (Stress) MPa | Max. Stress MPa | Elongation % 5.65/So |
|---|---|---|---|---|
| Circumferential | 437 | 448 | 491 | 8.9 |
| Axial | 416 | 426 | 462 | 7.5 |

These mechanical properties satisfy the customer specification requirement i.e., for engine pods, minimum 0.2% proof stress of 395 MPa and maximum stress 450 MPa. The internal stress is also of a suitable order for this application.

EXAMPLE 2

A forged preform of DTD. 731.B aluminium alloy having the spot composition Cu 2, Mg 1.5, Fe 1, Ni 1, Bal. Al, was conventionally ring rolled to produce a ring of the dimensions 1.0668 m outside diameter, 0.991 m inside diameter, and 101.6 mm thickness. This was solution treated, and then ring-rolled at room temperature to increase the ring diameter by 2%. The ring was then age hardened prior to machining, which produced very thin sections, of the order of 1.59 mm wall thickness in one area. The resultant component was completely free from distortion after machining, proving that the solution treated and age hardened ring prior to machining was in a stable and stress free condition thus allowing complex and thin sections to be machined without distortion.

While in accordance with the provisions of the statutes, that is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A continuous nonhydraulic stress-relieving process for the production of aluminium alloy rings, the process comprising ring rolling a hot ring blank of the aluminum alloy to a diametric size between 1% and 3% smaller than the desired dimensions of the finished ring, heating the ring to above the solidus point of the alloy, quenching the ring, cold ring rolling the ring to the desired dimension to relieve residual stresses in the alloy, and aging the ring prior to final machining.

2. The process according to claim 1 wherein the cold ring rolling step is carried out at room temperature.

3. The process according to claims 1 or 2 wherein the cold ring rolling step is carried out within 24 hours of quenching.

4. The process as claimed in claims 1 or 2 wherein the ring is rough machined before aging.

5. The process as claimed in claims 1 or 2 wherein the ring is made from aluminum alloy number 2014.

6. The process according to claim 3 wherein the ring is rough machined before aging.

7. The process according to claim 3 wherein the ring is made from aluminum alloy number 2014.

8. The process according to claim 4 wherein the ring is made from aluminum alloy number 2014.

9. The process according to claims 1 or 2 wherein the ring is made from aluminium alloy number 2618.

10. The process according to claim 3 wherein the ring is made from aluminium alloy number 2618.

11. The process according to claim 4 wherein the ring is made from aluminium alloy number 2618.

* * * * *